US011066717B2

(12) United States Patent
Park et al.

(10) Patent No.: US 11,066,717 B2
(45) Date of Patent: Jul. 20, 2021

(54) METHOD FOR MANUFACTURING GRAIN-ORIENTED ELECTRICAL STEEL SHEET

(71) Applicant: POSCO, Pohang-si (KR)

(72) Inventors: Chang Soo Park, Pohang-si (KR); Min Soo Han, Pohang-si (KR); Jong Ho Park, Pohang-si (KR); Hyung Don Joo, Pohang-si (KR); Yun Su Kim, Pohang-si (KR)

(73) Assignee: POSCO, Pohang-si (KR)

( * ) Notice: Subject to any disclaimer, the term of this patent is extended or adjusted under 35 U.S.C. 154(b) by 346 days.

(21) Appl. No.: 16/065,002

(22) PCT Filed: Dec. 20, 2016

(86) PCT No.: PCT/KR2016/014946
§ 371 (c)(1),
(2) Date: Jun. 21, 2018

(87) PCT Pub. No.: WO2017/111433
PCT Pub. Date: Jun. 29, 2017

(65) Prior Publication Data

US 2019/0017140 A1 Jan. 17, 2019

(30) Foreign Application Priority Data

Dec. 21, 2015 (KR) ..... 10-2015-0183224

(51) Int. Cl.
*C21D 8/12* (2006.01)
*C22C 38/02* (2006.01)
(Continued)

(52) U.S. Cl.
CPC ..... *C21D 8/1283* (2013.01); *C21D 8/12* (2013.01); *C21D 9/46* (2013.01); *C22C 38/001* (2013.01);
(Continued)

(58) Field of Classification Search
CPC ..... C21D 8/1283
See application file for complete search history.

(56) References Cited

U.S. PATENT DOCUMENTS 4,363,677 A * 12/1982 Ichiyama ..... C21D 1/09 148/111
5,342,454 A * 8/1994 Hayakawa ..... C21D 8/12 148/113
(Continued)

FOREIGN PATENT DOCUMENTS

CN 102041368 A 5/2011
EP 2940161 A1 11/2015
(Continued)

OTHER PUBLICATIONS

Muraki, Mineo et al. JP2003253334A—machine-generated text (Year: 2020).*
(Continued)

*Primary Examiner* — Alexandra M Moore
(74) *Attorney, Agent, or Firm* — Morgan, Lewis & Bockius LLP

(57) ABSTRACT

A manufacturing method of an oriented electrical steel sheet according to an exemplary embodiment of the present invention includes: a step of manufacturing a steel slab including one kind or more among Si at 2 to 7%, Sn at 0.03 to 0.10%, and Sb at 0.01 to 0.05% as wt %; a step of hot-rolling the steel slab to manufacture a hot rolled sheet; a step of cold-rolling the hot rolled sheet to manufacture a cold rolled sheet; a step of decarburizing and nitriding the cold rolled sheet for primary recrystallization annealing; a step of coating and drying an annealing separating agent on the primary recrystallization-annealed cold rolled sheet; and a step of secondary recrystallization-annealing the cold rolled sheet coated with the annealing separating agent.

9 Claims, 5 Drawing Sheets

(51) Int. Cl.

| | |
|---|---|
| ***C21D 9/46*** | (2006.01) |
| ***C22C 38/00*** | (2006.01) |
| ***C22C 38/04*** | (2006.01) |
| ***C22C 38/06*** | (2006.01) |
| ***C22C 38/60*** | (2006.01) |
| ***C22C 38/12*** | (2006.01) |
| ***C22C 38/14*** | (2006.01) |
| ***C22C 38/16*** | (2006.01) |
| ***C22C 38/08*** | (2006.01) |

(52) U.S. Cl.

CPC ..... *C22C 38/002* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/60* (2013.01); *C21D 8/1222* (2013.01); *C21D 8/1233* (2013.01); *C21D 8/1255* (2013.01); *C21D 8/1272* (2013.01)

(56) References Cited

U.S. PATENT DOCUMENTS

| | | | | |
|---|---|---|---|---|
| 5,840,131 | A * | 11/1998 | Yakashiro | C21D 8/1283 148/122 |
| 2009/0044881 | A1 | 2/2009 | Kumano et al. | |
| 2013/0180634 | A1 | 7/2013 | Han et al. | |
| 2014/0261895 | A1* | 9/2014 | Schrapers | C21D 8/1233 148/208 |
| 2015/0318092 | A1 | 11/2015 | Shingaki et al. | |
| 2016/0194731 | A1* | 7/2016 | Han | C22C 38/008 148/111 |

FOREIGN PATENT DOCUMENTS

| | | | | |
|---|---|---|---|---|
| JP | S59-222586 | A | | 12/1984 |
| JP | H02-0301571 | A | | 12/1990 |
| JP | H08-232019 | A | | 9/1996 |
| JP | H08232019 | A | * | 9/1996 |
| JP | 2003-213338 | A | | 7/2003 |
| JP | 2003-253334 | A | | 9/2003 |
| JP | 2003253334 | A | * | 9/2003 |
| JP | 2004-211145 | A | | 7/2004 |
| JP | 2007-254829 | A | | 10/2007 |
| KR | 10-2013-0026243 | A | | 3/2013 |
| KR | 10-2014-0062841 | A | | 5/2014 |
| KR | 20140062841 | A | * | 5/2014 |
| KR | 10-2014-0092467 | A | | 7/2014 |
| KR | WO-2014104762 | A1 | * | 7/2014 |

OTHER PUBLICATIONS

Kim, Byeong Goo et al. KR20140062841A—machine-generated text (Year: 2020).*

Iwanaga, Isao et al. JPH08232019A—machine-generated text (Year: 2020).*

Extended European Search Report dated Aug. 29, 2018 issued in European Patent Application No. 16879300.8.

Written Opinion and International Search Report dated Mar. 27, 2017 issued in International Patent Application No. PCT/KR2016/014946 (with English translation).

Japanese Office Action dated Jul. 9, 2019 issued in Japanese Patent Application No. 2018-532626.

Chinese Office Action dated May 5, 2019 issued in Chinese Patent Application No. 201680076272.7 (with English translation).

* cited by examiner

METHOD FOR MANUFACTURING GRAIN-ORIENTED ELECTRICAL STEEL SHEET

CROSS REFERENCE

This patent application is the U.S. National Phase under 35 U.S.C. § 371 of International Application No. PCT/KR2016/014946, filed on Dec. 20, 2016, which claims the benefit of Korean Patent Application No. 10-2015-0183224, filed on Dec. 21, 2015, the entire contents of each are hereby incorporated by reference.

TECHNICAL FIELD

A manufacturing method of an oriented electrical steel sheet is provided.

BACKGROUND ART

An oriented electrical steel sheet contains 3.1% of a Si component and has a texture in which an orientation of grains is in a {110}<001> direction. It is mainly used as an iron core of a transformer, an electric motor, a generator, other electronic devices, and the like, and uses extremely excellent magnetic properties in a rolling direction.

Recently, as high magnetic flux density grade directional electrical steel sheets have been commercialized, materials having less core loss have been required. This may be approached by the following four main technical methods: i) precisely orienting the {110}<001> crystal grain orientation including an easy magnetization axis of a directional electrical steel sheet 7 in a rolling direction; ii) rendering a material to be a thin plate; iii) miniaturizing a magnetic domain by a chemical or physical process; and iv) improving surface physical properties or imparting surface tension by a chemical process such as surface treating.

The last method among the above is to improve magnetism of a material by actively improving the properties of a directional electrical steel sheet surface. As a representative example thereof, a method of removing an oxide layer inevitably produced in the course of decarbonizing-annealing, and forsterite ($Mg_2SiO_4$), which is a base coating layer produced by a chemical reaction of a MgO slurry which is a coil fusion inhibitor, may be mentioned.

As a technology that removes the base coating layer, a method of forcibly removing a common product in which base coating is already formed like a common material with sulfuric acid or hydrochloric acid and a technology (hereinafter, a glassless or a glassless technology) removing or suppressing the base coating layer in a process in which the base coating layer is produced has been proposed.

To date, the primary research of the glassless technology has proceeded in two directions of a technology using a surface etching effect in a high temperature annealing process after adding chloride to MgO of an annealing separating agent, and a technology not forming the base coating layer itself in a high temperature annealing process after coating an $Al_2O_3$ powder of the annealing separating agent.

The ultimate object of these technologies is to remove a surface pinning site causing the magnetism deterioration, to ultimately improve the magnetism of the oriented electrical steel sheet by preventing formation of the base coating layer in the manufacturing of the electrical steel sheet.

As described above, the two proposed glassless methods, that is, both of the method of suppressing the formation of the forsterite layer and the technology of separating the base coating layer from a mother material in a high temperature annealing process, have a problem in a process in which an oxidation capacity ($PH_2O/PH_2$) in a furnace must be controlled to be very low through hydrogen, nitrogen gas, and a dew point change at the time of the decarbonizing-annealing process. The reason for controlling the oxidation capacity to be low is to suppress the formation of the base coating layer to the utmost by minimizing the oxidation layer formed on the mother material surface at the time of decarburization, and also the oxidation layer produced when the oxidation capacity is low in the furnace is mostly composed of silica ($SiO_2$) such that the iron-based oxide production may be suppressed, thereby there is a merit that the iron-based oxide does not remain on the surface after high temperature annealing. However, in such a case, because it is difficult to secure an appropriate primary recrystallization grain size due to decarburization failure and a problem may also occur in secondary recrystallization grain growth during high temperature annealing, the decarburization process must be longer than the processing process of the common material in order to thin the oxidation layer while properly securing the decarburization characteristic, thereby productivity is deteriorated.

In the manufacturing of the low core loss oriented electrical steel sheet through the conventional glassless technology, an inhibitor existing in the steel is abruptly diffused to the surface side and disappears due to the thin oxidation layer at the time of high temperature annealing such that there is a problem that the secondary recrystallization is unstable, and as a method solving this problem, an ordinal pattern controlling the atmosphere at the time of high temperature annealing and slowing the temperature raising rate in the temperature raising period is applied to suppress the inhibitor in the steel from being diffused to the surface side.

Also, in the method of controlling the conventional oxidation capacity to be low to maximally suppress the formation of the base coating layer by minimizing the formation of the oxidation layer, when executing a heat treatment on a coil at the time of high temperature annealing, different dew points and temperature movements occur depending on a position of the sheet in the coil at the time of high temperature annealing, and in this case, there is a difference in the formation of the base coating layer, which causes a glassless degree difference according thereto, and it may become a big problem in mass production because of sheet partial deviation generation.

Therefore, in order to manufacture the low core loss oriented electrical steel sheet through the current glassless method, the productivity deterioration may be avoided in the decarburization process and high temperature annealing, and as a result, despite the fact that the glassless process is extremely useful in terms of technology, it is not currently commercialized.

DISCLOSURE

Technical Problem

The manufacturing method of the oriented electrical steel sheet, in which the core loss is extremely low and an excellent forsterite removal process (hereinafter referred to as "a base coating free" process) is introduced in a productivity aspect, is provided.

Technical Solution

A manufacturing method of an oriented electrical steel sheet according to an exemplary embodiment of the present invention includes: a step of manufacturing a steel slab including one kind or more among Si at 2 to 7%, Sn at 0.03 to 0.10%, and Sb at 0.01 to 0.05% as wt %; a step of hot-rolling the steel slab to manufacture a hot rolled sheet; a step of cold-rolling the hot rolled sheet to manufacture a cold rolled sheet; a step of decarburizing and nitriding the cold rolled sheet for primary recrystallization annealing; a step of coating and drying an annealing separating agent on the primary recrystallization-annealed cold rolled sheet; and a step of secondary recrystallization-annealing the cold rolled sheet coated with the annealing separating agent, wherein the primary recrystallization annealing may be performed by passing through a heating zone, a primary soaking zone, and a secondary soaking zone, and may satisfy Equation 1 and Equation 2 below when each dew point is t1, t2, and t3:

$$50^\circ\ \text{C.} \le t1 \le t2 \le t3 \le 70^\circ\ \text{C.} \quad (1)$$

$$t2 - t1 \ge 4^\circ\ \text{C.} \quad (2)$$

and the dew point of the primary soaking zone and the secondary soaking zone may satisfy Equation 3 below:

$$t3 - t2 \ge 4^\circ\ \text{C.} \quad (3)$$

wherein the annealing separating agent may include a magnesium oxide or a magnesium hydroxide, and a metal iodide.

A forsterite ($Mg_2SiO_4$) film may be removed in the step of secondary recrystallization annealing.

After the primary recrystallization annealing, a mother material metal layer, a segregation layer, and an oxidation layer may be sequentially formed, and the segregation layer may include 50 to 100 wt % of one kind or more of Sb and Sn.

The thickness of the oxidation layer may be from 0.5 to 2.5 μm, and an oxygen amount of the oxidation layer may be 600 ppm or more.

The annealing separating agent may include the magnesium oxide or magnesium hydroxide at 100 parts by weight and the metal iodide at 5 to 20 parts by weight.

A metal forming the metal iodide may include one selected from Ag, Co, Cu, and Mo, and combinations thereof.

The step of the secondary recrystallization annealing may be performed in a temperature range of 650 to 1200° C.

In the step of the secondary recrystallization annealing, the cold rolled sheet may be heated from 650 to 1200° C. with a temperature raising rate of 0.1 to 20° C./h, and may be maintained for 20 hours or more in a temperature range of 1150 to 1250° C. after reaching 1200° C.

A surface roughness of the oriented electrical steel sheet may be 0.8 μm or less as a Ra value.

The surface of the oriented electrical steel sheet may include protrusions and depressions parallel to a rolling direction.

According to the present invention, the oxidation layer produced in the primary recrystallization annealing process and the magnesium oxide (MgO) existed in the annealing separating agent forms the forsterite ($Mg_2SiO_4$) film produced through the chemical reaction in the secondary recrystallization annealing process to be uniformly removed, thereby controlling the surface characteristic of the oriented electrical steel sheet.

For the oriented electrical steel sheet with the forsterite film removed, a pinning point as a main factor restricting mobility of magnetic domains may be excluded and a core loss of the oriented electrical steel sheet may be improved.

Advantageous Effects

MODE FOR INVENTION

Terms used throughout the specification, such as 'first', 'second', 'third', etc., can be used to describe various portions, components, regions, layers, and/or sections, but are not limited thereto. These terms are used only to differentiate any portion, component, region, layer, or section from other portions, components, regions, layers, or sections. Therefore, a first portion, component, region, layer, section, and the like which are described below may be mentioned as a second portion, component, region, layer, section and the like within a range without deviating from the scope of the present invention.

The terminologies used hereafter are only for describing specific exemplary embodiments and are not intended to limit the present invention. Singular terms used herein include plural terms unless phrases clearly express opposite meanings. The term 'including' used herein embodies concrete specific characteristics, regions, positive numbers, steps, operations, elements, and/or components, without limiting existence or addition of other specific characteristics, regions, positive numbers, steps, operations, elements, and/or components.

It will be understood that when an element such as a layer, film, region, or substrate is referred to as being "on" or "above" another element, it can be directly on or above the other element or intervening elements may also be present. In contrast, when an element is referred to as being "directly on" another element, there are no intervening elements therebetween.

If not defined differently, all the terminologies including the technical terminologies and scientific terminologies used herein have meanings that are the same as ones that those skilled in the art generally understand. The terms defined in dictionaries should be construed as having meanings corresponding to the related prior art documents and those stated herein, and are not to be construed as being ideal or official, if not so defined.

Hereinafter, exemplary embodiments of the present invention will be described in detail so as to be easily practiced by a person skilled in the art to which the present invention pertains. As those skilled in the art would realize, the described embodiments may be modified in various different ways, all without departing from the spirit or scope of the present invention.

Figure 1:
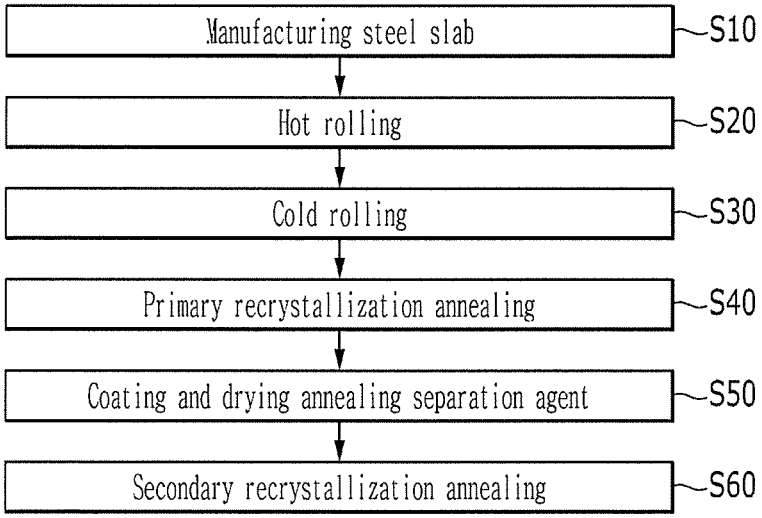
FIG. 1 is a schematic flowchart of a manufacturing method of an oriented electrical steel sheet according to an exemplary embodiment of the present invention.

FIG. 1 is a schematic flowchart of a manufacturing method of an oriented electrical steel sheet according to an exemplary embodiment of the present invention. The flowchart of the manufacturing method of the oriented electrical steel sheet of FIG. 1 illustrates the present invention, and the present invention is not limited thereto. Accordingly, the manufacturing method of the oriented electrical steel sheet may be variously changed.

A manufacturing method of an oriented electrical steel sheet according to an exemplary embodiment of the present invention includes: a step S10 of manufacturing a steel slab including one kind or more among Si at 2 to 7%, Sn at 0.03 to 0.10%, and Sb at 0.01 to 0.05% as wt %; a step S20 of hot-rolling a steel slab to manufacture a hot rolled sheet; a step S30 of cold-rolling the hot rolled sheet to manufacture a cold rolled sheet; a step S40 of decarburizing and nitriding the cold rolled sheet as primary recrystallization annealing; a step S50 of coating and drying an annealing separating agent on the primary recrystallization-annealed cold rolled sheet; and a step S60 of secondary recrystallization-annealing the cold rolled sheet to which the annealing separating agent is coated.

First, in the step S10, the steel including one kind or more among Si at 2 to 7%, Sn at 0.03 to 0.10%, and Sb at 0.01 to 0.05% as wt % is manufactured. Here, Sn and Sb may be included singly or may be simultaneously included. Si, Sn, or Sb is an element indispensably included in an exemplary embodiment of the present invention, and C, Al, N, P, Mn, etc. may be additionally included.

In detail, the steel slab may include one kind or more among Si at 2 to 7%, C at 0.01 to 0.085%, Al at 0.01 to 0.045%, N at less than 0.01%, P at 0.01 to 0.05%, Mn at 0.02 to 0.5%, S at less than 0.0055% (excluding 0%), Sn at 0.03 to 0.10%, and Sb at 0.01 to 0.05% as wt %, and Fe and other unavoidable impurities as a balance.

Next, each composition of the steel slab is described in detail.

Si: 2 to 7 wt %

Si as a base composition of the electrical steel sheet has a function of increasing specific resistance of a material to decrease a core loss.

When the content of Si is very low, the specific resistance is decreased, through which the eddy current loss is increased, the core loss characteristic is deteriorated, a phase transformation is active between ferrite and austenite at the time of the decarburization nitride annealing such that the primary recrystallization texture may be severely damaged. Also, phase transformation is generated between ferrite and austenite at the time of high temperature annealing such that the secondary recrystallization may not only be unstable, but also {110} Goss texture may be severely damaged.

In the case in which the content of Si exceeds the range, in the primary recrystallization annealing, $SiO_2$ and $Fe_2SiO_4$ oxidation layers are excessively and densely formed to delay the decarburization behavior, and therefore, the phase transformation between ferrite and austenite is continuously generated during the primary recrystallization annealing process, such that a primary recrystallization texture is severely damaged. Nitriding behavior is delayed due to a decarbonization behavior delay effect depending on the formation of the dense oxide layer described above, such that nitrides such as (Al, Si, Mn)N, AlN, and the like, are not sufficiently formed. Therefore, sufficient crystal grain inhibition ability required for the secondary recrystallization at the time of the secondary recrystallization annealing may not be secured. Therefore, the content of Si may be controlled within the above-described range.

C: 0.01 to 0.085 wt %

C as an element causing the phase transformation between ferrite and austenite is an essential element for improving a rolling property of the grain-oriented electrical steel sheet having a poor rolling property due to high brittleness, however, since the carbides formed due to a magnetic aging effect in the case in which it remains in a final product deteriorate the magnetic characteristics, the content of C needs to be appropriately controlled.

When the content of C is very low, since the phase transformation between ferrite and austenite is not normally generated, non-uniformity of a slab and a hot rolled microstructure may be caused. Also, if the phase transformation between ferrite and austenite is excessively large at the time of a hot rolled sheet annealing heat treatment, the precipitates re-employed at the time of a slab reheat are coarsely precipitated such that the primary recrystallization microstructure becomes non-uniform, and the secondary recrystallization behavior becomes unstable depending on lack of a crystal grain growth inhibitor at the time of the secondary recrystallization annealing.

On the other hand, when the content of C is too large, since C may be not sufficiently decarburized in the general primary recrystallization process, a problem that removal of C is not easy may occur. Furthermore, if the decarburization is not sufficient, a deterioration phenomenon of the magnetic characteristics by magnetic aging is caused at the time of applying a final product to an electric power device. Therefore, the content of C may be controlled within the above-described range. The carbon in the steel sheet that is finally-manufactured after the decarburization may be included at 0.005 wt % or less.

Al: 0.01 to 0.045 wt %

Al is combined with Al, Si, and Mn in which nitrogen ions introduced by an ammonia gas exist in a solid-dissolved state within steel in an annealing process after cold rolling, as well as AlN finely precipitated at the time of the hot rolling and the hot-rolled sheet annealing, thereby forming (Al, Si, Mn)N and AlN-type nitrides to serve as strong crystal grain growth inhibitors.

When the content of Al is very low, the number and a volume of materials described above are significantly low, such that a sufficient effect of the materials described above as the inhibitors may not be expected.

When the content of Al is too large, coarse nitrides are formed, such that the crystal grain growth inhibition ability is decreased. Therefore, the content of Al may be controlled within the above-described range.

N: 0.01 wt % or less (excluding 0 wt %)

N is an important element forming AlN by reacting with Al.

When the content of N is too large, a surface defect such as a blister is caused by nitrogen diffusion in a process after hot rolling, and since an excessively large amount of nitrides is formed in a slab state, rolling becomes difficult, such that the next process may be complicated and manufacturing cost may be increased.

Meanwhile, N is additionally required in order to form nitrides such as (Al, Si, Mn)N, AlN, (B, Si, Mn)N, (Al, B)N, BN, and the like, which is reinforced by performing nitriding in steel using an ammonia gas in the primary recrystallization annealing step S40 to be described later. Therefore, the content of N may be controlled within the above-described range.

P: 0.01 to 0.05 wt %

P promotes the growth of primary recrystallized grains in a low temperature heating type of directional electrical steel sheet, and thus, increases the integration of the {110}<001> orientation in the final product by increasing the secondary recrystallization temperature. When the primary recrystallized grains are excessive, the secondary recrystallization is unstable, however, it is advantageous for magnetism to have the large primary recrystallized grains in order to raise the secondary recrystallization temperature, as long as secondary recrystallization occurs.

Meanwhile, P increases the number of crystal grains having the {110}<001> orientation in the primary recrystallized steel sheet to lower core loss in the final product, and also strongly develops {111}<112> aggregation texture in the primary recrystallized sheet to improve the {110}<001> integration in the final product, thereby increasing magnetic flux density.

Further, P has a function of enhancing suppression force by being segregated in a grain boundary up to a high temperature of about 1000° C. to delay decomposition of precipitates, during secondary recrystallization annealing.

If the content of P is too large, the size of primary recrystallized grains is rather decreased, so that secondary recrystallization is unstable, and also brittleness is increased to hinder cold rolling. Therefore, the content of P may be controlled within the above-described range.

Mn: 0.02 to 0.5 wt %

Mn increases the specific resistance to decrease the eddy current loss, resulting in a decrease in entire core loss, similar to Si.

As the precipitates of (Al, Si, Mn)N are formed by reacting with nitrogen introduced by the nitriding together with Si, Mn is an important element in inhibiting growth of primary recrystallized grains and generating the secondary recrystallization. 0.20 wt % steel sheet surface If a large amount of Mn is added, large amounts of (Fe, Mn) and Mn oxides are formed in addition to $Fe_2SiO_4$ on a surface of the steel sheet to hinder the base coating from being formed at the time of the high temperature annealing, resulting in deterioration of surface quality, since phase transformation between ferrite and austenite is caused in the secondary recrystallization annealing process S60, the texture is severely damaged, such that the magnetic characteristics are significantly deteriorated. Therefore, the content of Mn may be controlled within the above-described range.

S: 0.0055 wt % or less (excluding 0 wt %)

S is an element forming MnS by reacting with Mn.

If the content of S is too large, precipitates of MnS are formed in the slab to inhibit crystal grain growth, and S is segregated at a central portion of the slab at the time of casting, such that it is difficult to control a microstructure in the subsequent process. Therefore, the content of S may be controlled within the above-described range.

One or more of Sn at 0.03 to 0.10% and Sb at 0.01 to 0.05%

When Sn is added, iron loss may be improved by increasing the number of secondary nuclei in the {110}<001> orientation, in order to decrease the size of secondary crystal grains. Further, Sn has an important function to suppress crystal grain growth through segregation in a grain boundary, which compensates for reduction of the effect of suppressing crystal grain growth, as AlN particles coarsen, and the content of Sincreases. Accordingly, successful formation of a {110}<001> secondary recrystallization aggregation texture may be consequently guaranteed even in the case of having a relatively high content of Si. That is, the Si content may be increased, and also the final thickness may be decreased without weakening the completeness of a {110}<001> secondary recrystallization structure.

Further, when the Sn content is excessive, brittleness may be increased.

That is, as described above, when the content range of Sn is adjusted to that described above, a discontinuous and remarkable iron loss reduction effect that could not be conventionally predicted may be obtained. Therefore, the content of Sn may be controlled within the above-described range.

Sb performs an operation of suppressing excessive growth of a primary recrystallized grain by segregation in a grain boundary. By removing non-uniformity of a primary recrystallized grain size according to a thickness direction of a sheet and simultaneously stably forming secondary recrystallization by suppressing grain growth in a primary recrystallization step by adding Sb, an oriented electrical steel sheet having more excellent magnetism may be formed.

Sb performs an operation of suppressing excessive growth of a primary recrystallized grain by segregating in a grain boundary, but when the content of Sb is too low, it is difficult to appropriately exhibit the operation thereof.

When the content of Sb is too large, a primary recrystallized grain size excessively decreases and thus a secondary recrystallization start temperature is lowered, whereby a magnetic characteristic is deteriorated or a suppressing force of grain growth excessively increases and thus secondary recrystallization may not occur. Therefore, the content of Sb may be controlled within the above-described range.

One or both of Sn and Sb may be included. If one is included, Sn at 0.03 to 0.10% or Sb at 0.01 to 0.05% may be included. When both of Sn and Sb are included, a sum content of Sn and Sb may be 0.04 to 0.15%.

In addition to the above metallurgical merit, when one or both of Sn and Sb that are used as major elements are added to the steel slab, high temperature oxidation resistance is improved. That is, when one or both of Sn and Sb are added, a fayalite ($Fe_2SiO_4$) concentration within the innermost layer of the surface oxidation layer is not high. However, the property of the innermost layer is changed and the diffusion speed is deteriorated in the oxidization gas, so that the high temperature oxidation resistance may be improved.

The content of one or more of Sn and Sb is a very important precondition for producing a base coated pre-oriented electrical steel sheet according to an exemplary embodiment of the present invention. In order to exhibit the magnetically excellent characteristic for the base coated pre-oriented electrical steel sheet, the entire thickness of the oxidation layer 30 must be induced to be thin while suppressing the oxidation layer 30 produced during the primary recrystallization annealing process S40 from being deeply penetrated inside the mother material metal layer 10. In this case, the oxidation layer 30 is not diffused in the thickness direction of the mother material metal layer 10, but forms a thickening layer of a band shape on the surface of the mother material metal layer 30. In this case, the thickness of the oxidation layer 30 may be simultaneously controlled to be thin at 0.5 to 2.5 μm while increasing an oxygen amount of the oxidation layer to 30 to 600 ppm or more.

After the step S10, the steel slab may be reheated.

Next, in the step S20, the steel slab is hot-rolled to produce the hot rolled sheet. In this case, the thickness of the hot rolled sheet may be from 2.0 to 2.8 mm.

Next, in the step S30, the hot rolled sheet is cold-rolled to produce the cold rolled sheet. The hot rolled sheet may be cold-rolled from the hot rolled sheet annealing and acid washing. In this case, the thickness of the cold rolled sheet may be from 1.5 to 2.3 mm.

Next, in the step S40, the cold rolled sheet is annealed for the primary recrystallization.

When a cold rolling plate passes through a heating furnace that is controlled to have a humid atmosphere for the decarburization and nitriding, Si having highest oxygen affinity in the steel reacts with oxygen that is supplied from water vapor within a furnace and thus $SiO_2$ is first formed at the surface. Next, as oxygen penetrates the cold-rolling steel, a Fe-based oxide is produced. The thus formed silica oxide forms a forsterite ($Mg_2SiO_4$) film (base coating layer) through a Chemical Reaction Scheme 3.

$$2Mg(OH)_2+SiO_2 \rightarrow Mg_2SiO_4+2H_2O \square\square\square 3$$

As in Chemical Reaction Scheme 3, when a silica oxide reacts with a magnesium slurry in a solid state, in order to perform a complete chemical reaction, a material with a catalyst function of connecting between two solids is required, and fayalite ($Fe_2SiO_4$) performs the catalyst function. Therefore, in a common material having the base coating, appropriate fayalite forming as well as a $SiO_2$ forming amount is important.

The form of the oxidation layer after the primary recrystallization annealing (decarbonizing-annealing) of the electrical steel sheet is one in which the oxide of the black color part is embedded in a metal matrix. This layer is controlled by controlling a temperature, an atmosphere, a dew point, etc. of the furnace, so that the base coating is well formed.

However, as the glassless process has a concept of removing the base coating layer in a rear end portion after minimally forming a base coating layer that disturbs magnetic domain movement of a material in a front end portion of a high temperature annealing process, commonly, the silica oxide is minimally formed in the primary recrystallization annealing process, and then is reacted with an annealing separation slurry that is substituted with magnesium hydroxide ($Mg(OH)_2$) to induce separation from a mother material after forming a forsterite layer.

Accordingly, in a case of the common glassless manufacturing process, it is advantageous to form a smaller silica oxide layer and also to produce a very small amount of fayalite on the surface of the material through control of the dew point, a soaking temperature, and an atmosphere gas at the time of the decarburization and nitriding. This is because fayalite, as the material promoting a reaction between the silica oxide and magnesium, forms an iron-based oxide mound (hereinafter, an Fe mound) as an iron-based oxide at the time of base coating formation and is attached to the material surface as it is without dripping from the mother material by steaming of a glassless-based additive, in such a case, not only may the glassless process's target surface not obtain beautiful products, but magnetism also becomes very inferior.

Because of manufacturing problems of the glassless manufacturing process, while the oxidation capacity is controlled to be low at the time of the primary recrystallization annealing in the common glassless process to produce the low oxidation layer and to induce a composition of the produced oxidation layer to the silica oxide, a decarburization property deterioration problem of the material due to low oxidation capacity is solved by elongating a processing time of the decarburization. Therefore, productivity is deteriorated. Also, there is a problem that an inhibitor existing in the steel at the time of the high temperature annealing is suddenly diffused and disappears to the surface side due to the thin oxidation layer such that the secondary recrystallization becomes unstable, and accordingly, in a conventional glassless process, the ordinal pattern slowing a temperature raising rate in a high nitrogen atmosphere and a temperature raising period at the time of the secondary recrystallization annealing (high temperature annealing) to suppress the inhibitor in the steel from being diffused to the surface side, however the productivity deterioration may not be avoided like in the primary recrystallization annealing process.

As described above, when manufacturing a product through the conventional glassless process, the productivity decreases dramatically as compared with the ordinary oriented electrical steel sheet having the base coating. Furthermore, a mirror surface and magnetism deviation due to inhibitor instability at the time of the high temperature annealing are very serious. In an exemplary embodiment of the present invention, a method of increasing an oxygen amount of the oxidation layer 30 is provided to well form a glass film and to easily separate the glass film later.

The oxidation layer is a layer in which an inner oxide is imbedded in the metal base and is divided from the mother material metal layer 10 further inside in the thickness direction. A method of reducing the total thickness of the oxidation layer 30 while increasing the oxygen amount of the oxidation layer 30 to form the glass film well is proposed. For this, in the primary recrystallization annealing process S40, a method of forming the high oxygen amount in the oxidation layer that is entirely formed instead of maintaining the thin thickness of the oxidation layer 30 is provided by actively using a mechanism of the oxidation layer 30 formed on the material surface and a segregation phenomenon of a segregation element included in the steel to appropriately maintain a temperature for each period and an oxidation degree at the time of the segregation of the segregation element and the primary recrystallization annealing.

The thickness of the oxidation layer 30 becomes thicker in a heating zone and the primary soaking zone in which the cold-rolling sheet is controlled in a humid atmosphere for the decarburization in the primary recrystallization annealing step S40. In an exemplary embodiment of the present invention, in the primary recrystallization annealing step S40, by segregating Sb or Sn of the segregation element to an interface side of the oxidation layer 30 and the metal base layer 10 to form a segregation layer 20, the thickness of the oxidation layer 30 is prevented from becoming thicker.

Figure 2:
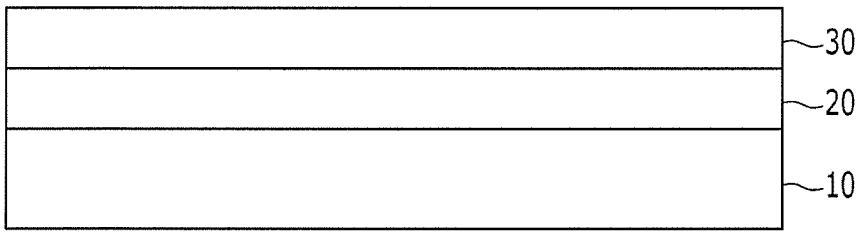
FIG. 2 is a schematic side view of a cold rolled sheet after a step S40 in a manufacturing method of an oriented electrical steel sheet according to an exemplary embodiment of the present invention.

That is, in the step S40, as shown in the schematic view of FIG. 2, the mother material metal layer 10, the segregation layer 20, and the oxidation layer 30 may be sequentially formed. The segregation layer 20 is formed as Sn and Sb are segregated in the mother material metal layer 10.

The primary recrystallization annealing is performed while passing through the heating zone, the primary soaking zone, and the secondary soaking zone, and when each dew point is referred to as t1, t2, and t3, Equation 1 and Equation 2 may be satisfied.

$$50^\circ\ C. \leq t1 \leq t2 \leq t3 \leq 70^\circ\ C. \quad (1)$$

$$t2-t1 \geq 4^\circ\ C. \quad (2)$$

If the dew point is lower than 50° C., defects may be generated in the decarburization. Also, if the dew point is higher than 70° C., the oxidation layer 30 is excessively produced such that a large amount of a residue may be generated on the surface after removing the forsterite ($Mg_2SiO_4$) film in the secondary recrystallization annealing step. Accordingly, the dew point of the heating zone, the primary soaking zone, and the secondary soaking zone may be controlled within the above-described range.

In detail, the thickness of the oxidation layer 30 formed in the step S40 may be from 0.5 to 2.5 μm, and the oxygen amount of the oxidation layer 30 may be 600 ppm or more. In further detail, the thickness of the oxidation layer 30 may be from 0.5 to 2.5 μm, and the oxygen amount of the oxidation layer 30 may be from 700 to 900 ppm.

The step S40 may be performed in a gas atmosphere of hydrogen, nitrogen, and ammonia. In detail, it may be performed in an atmosphere including nitrogen at 40 to 60 volume %, ammonia at 0.1 to 3 volume %, and hydrogen as a balance.

Next, in the step S50, an annealing separating agent is coated and dried on the cold rolled sheet subjected to the primary recrystallization annealing. In detail, the annealing separating agent may include a magnesium oxide or a magnesium hydroxide, and a metal iodide.

The magnesium oxide or magnesium hydroxide as a main component of the annealing separating agent reacts with $SiO_2$ existing on the surface like the above-described Chemical Reaction Scheme 3 to form the forsterite ($Mg_2SiO_4$) film.

On the other hand, the metal iodide is used to remove the base coating in the secondary recrystallization annealing step. Generally, a metal chloride has mainly used to eliminate the base coated pre-oriented electrical steel sheet so far. For example, in a case of $BiCl_3$ as one kind of the metal chloride, at the time of the high temperature annealing, CI atoms (CI atoms of $BiCl_3$) are diffused toward the surface of the steel sheet, rather than going out of the steel sheet due to a pressure in the furnace, and as a result, a chemical reaction like Chemical Formula 4 below is caused on a boundary of the steel sheet and the base coating thereof.

$$Fe+2Cl \rightarrow FeCl_2 \quad (4)$$

Since a vaporization point of thus produced $FeCl_2$ is 1025° C., it is theoretically possible to remove the base coating from the surface of the steel sheet while $FeCl_2$ is vaporized in the secondary recrystallization annealing step.

However, since hydrogen and nitrogen are practically mixed in a high temperature annealing furnace, the $FeCl_2$ induces a reaction represented by Chemical Reaction Scheme 5.

$$FeCl_2+H_2 \rightarrow 2HCl+Fe \quad (5)$$

If the reaction of Chemical Reaction Scheme 5 occurs before the vaporization temperature of $FeCl_2$ reaches 1025° C., a HCl gas is produced on the boundary of the steel sheet and the base coating and it is possible to eliminate the oxidation layer by the HCl gas. However, when the base coating is eliminated at the vaporization temperature of $FeCl_2$ of less than 1025° C., only the magnetic characteristic of the final obtained oriented electrical steel sheet can be deteriorated.

In detail, during the high temperature annealing process, the secondary recrystallization grain is formed and the secondary recrystallization grain has an important influence on the core loss reduction and the magnetic flux density improvement of the oriented electrical steel sheet, and if it is generally considered that the secondary recrystallization phenomenon starts between about 1050 and 1100° C., the temperature of less than the vaporization temperature (i.e., 1025° C.) of $FeCl_2$ is too low for the sufficient secondary recrystallization to take place.

More specifically, until the temperature region where the secondary recrystallization occurs, it is necessary to suppress the growth of the crystal grain by making the inhibitor exist stably in the steel plate part.

If the base coating exists, the decomposition of the precipitates may be suppressed by preventing the gas such as hydrogen and nitrogen in the furnace from being directly contacted, the base coating already falls by the HCl until the start temperature of the secondary recrystallization, and the decomposition of the inhibitor is caused on the surface of the exposed steel sheet such that the growth of the crystal grain is not suppressed, and as a result, the secondary recrystallization grain may be not normally formed.

Also, the HCl gas has a danger of corroding the furnace due to its high reactivity with the metal material, and since this corresponds to a toxic gas, there is also a drawback of being environmentally harmful.

In contrast, when using the metal iodide instead of the metal chloride, after $FeI_t$ instead of $FeCl_2$ is produced on the steel sheet and the interface of the oxidation layer, the reaction represented by Chemical Reaction Scheme 6 occurs by the influence of the atmosphere in the furnace.

$$FeI_2+H_2 \rightarrow 2HI+Fe6$$

Also, in this case, the produced HI gas escapes from the base coating while being extricated outside the steel sheet, however the base coating may be eliminated at a temperature as high as 80° C. higher than when using the metal chloride regardless of a partial pressure of hydrogen and nitrogen in the furnace.

Particularly, when a ratio of hydrogen and nitrogen is 0.25:0.75, it is confirmed that the temperature at which the base coating is eliminated from the steel sheet surface is about 1045° C., and this corresponds to a temperature that is similar to the temperature at which the secondary recrystallization starts.

Accordingly, the inhibitor inside the steel sheet may stably exist until the temperature that is relatively higher than that of the metal chloride when using the metal iodide as the annealing separating agent.

In other words, the metal iodide is a more advantageous material for inducing the secondary recrystallization having the excellent core loss characteristic than the metal chloride, and has a safer characteristic in terms of the corrosion of the high temperature annealing furnace or a poisonous aspect.

In detail, the annealing separating agent may include 100 parts by weight of the magnesium oxide or magnesium hydroxide and 5 to 20 parts by weight of the metal iodide.

If too little of the metal iodide is contained, the reaction in Chemical Reaction Scheme 6 is not sufficient such that the mirror surface degree may be bad. When too much of the metal iodide is included, the formation of the base coating is not smooth at the beginning of the secondary recrystallization annealing step, and the decomposition of the inhibitor occurs before reaching the secondary recrystallization starting temperature, thereby causing a result that the magnetism is bad. Accordingly, the content of the metal iodide is limited to the above-described range.

Also, the metal forming the metal iodide may be one metal selected from a group including Ag, Co, Cu, Mo, and combinations thereof.

In the step S50, a coating amount of the annealing separating agent may be from 6 to 20 g/m$^2$. If the coating amount of the annealing separating agent is too low, the base coating formation may not be smooth. If the annealing separating agent coating amount is too large, the secondary recrystallization may be influenced. Accordingly, the coating amount of the annealing separating agent may be controlled within the above-described range.

In the step S50, the temperature of the annealing separating agent may be from 300 to 700° C. If the temperature is too low, the annealing separating agent may be easily dried. If the temperature is too high, the secondary recrystallization may be affected. Accordingly, the drying temperature of the annealing separating agent may be controlled within the above-described range.

Next, in the step S60, the cold rolled sheet on which the annealing separating agent is coated is secondary recrystallization-annealed.

Since the step S60 includes a step in which the temperature is raised from room temperature to 1200° C., the cold rolled sheet is heated with a temperature raising rate of 0.1 to 20° C./h in a range from 650 to 1200° C., and after reaching 1200° C., the temperature range of 1150 to 1250° C. is maintained for 20 hours or more.

When the temperature raising rate is too low, it takes a long time such that a problem may be generated in terms of productivity, and if the temperature raising rate is too high, instability of the inhibitor is high such that the secondary recrystallization grain growth may not occur well.

The reason for maintaining the temperature for 20 hours or more after reaching 1200° C. is to induce smoothing of the steel sheet surface exposed outside, and sufficient time is necessary to remove impurities such as nitrogen and carbon present in the steel sheet.

In the step S60, the raising of the temperature from 700 to 1200° C. is performed in an atmosphere including 20 to 30 volume % of nitrogen and 70 to 80 volume % of hydrogen, and may be performed in an atmosphere including 100 volume % of hydrogen after reaching 1200° C. By controlling the atmosphere within the above-described range, the forsterite film may be smoothly formed.

According to the manufacturing method of the oriented electrical steel sheet according to an exemplary embodiment of the present invention, the amount of the oxidation layer is almost the same as that of ordinary materials, but the thickness of the oxidation layer is usually formed thinner thereof than 50% or less with respect to the ordinary materials such that the forsterite layer may be smoothly removed in the secondary recrystallization annealing step, thereby obtaining a metal gloss oriented electrical steel sheet in which a mobility of magnetic domains of the mother material is easy.

According to the manufacturing method of the oriented electrical steel sheet according to an exemplary embodiment of the present invention, roughness and glossiness increase. The surface of the oriented electrical steel sheet manufactured by an exemplary embodiment of the present invention has roughness Ra of 0.8 μm or less.

Figure 3:
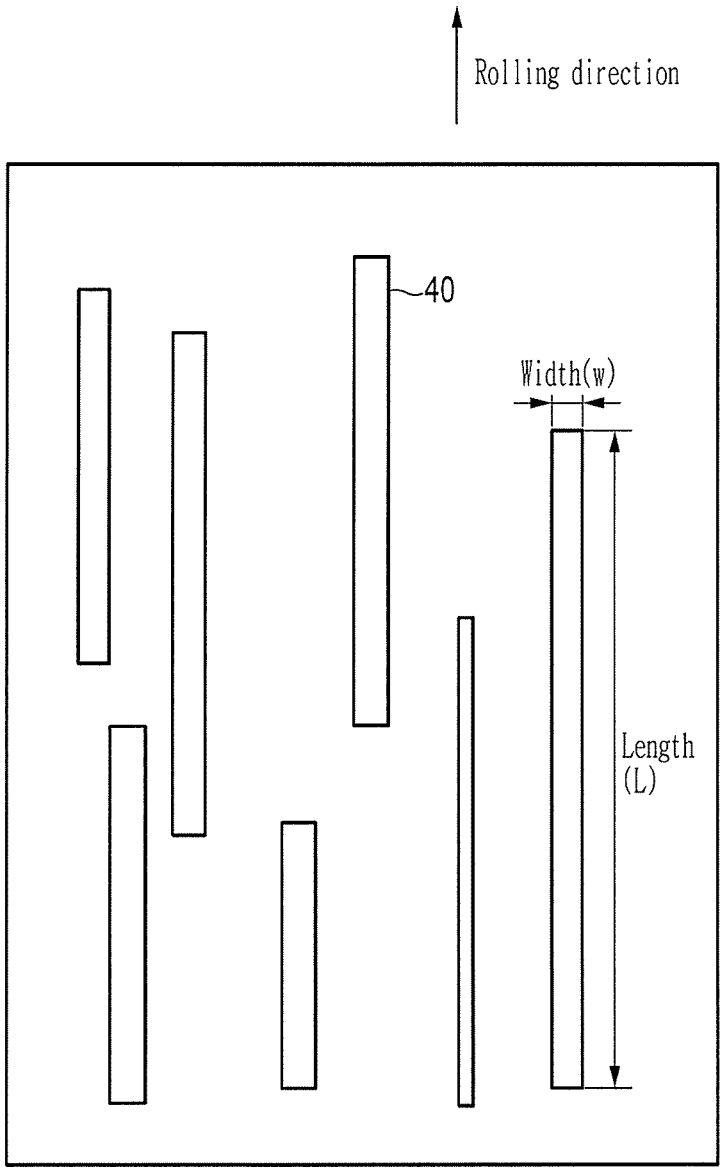
FIG. 3 is a schematic view of a surface of an oriented electrical steel sheet according to an exemplary embodiment of the present invention.

Also, as schematically shown in FIG. 3, the surface of the oriented electrical steel sheet has protrusions and depressions 40 parallel to a rolling direction.

In the oriented electrical steel sheet according to an exemplary embodiment of the present invention, the roughness is relatively high and the glossiness is decreased. It is considered that this is because the time for the delamination of the forsterite film is relatively long near 1025 to 1100° C. during the secondary recrystallization annealing such that the time of the planarization of the surface by the heating after the delamination is not sufficient. However, in association with this, the inhibitor stability is excellent in the secondary recrystallization annealing step such that it is easy to secure the magnetism.

Next, the present invention is described further in detail through examples. However, these examples are meant to illustrate the present invention and the present invention is not limited here.

EXAMPLES

A steel slab including Si at 3.2%, Sn at 0.06%, and Sb at 0.025% as wt % is hot-rolled to form a hot rolled sheet with a thickness of 2.6 mm, and then the hot rolled sheet is cold-rolled to a 0.30 mm thickness as a final thickness after the hot rolled sheet annealing and the acid washing.

The cold-rolled steel sheet is next annealed for the primary recrystallization, is maintained for 180 seconds at a temperature of 875° C., and simultaneous decarburization and nitride processing is performed. In this case, the dew point of the heating zone, the primary soaking zone, and the secondary soaking zone are controlled as shown in Table 1 below to control the produced oxidation layer amount.

Figure 4:
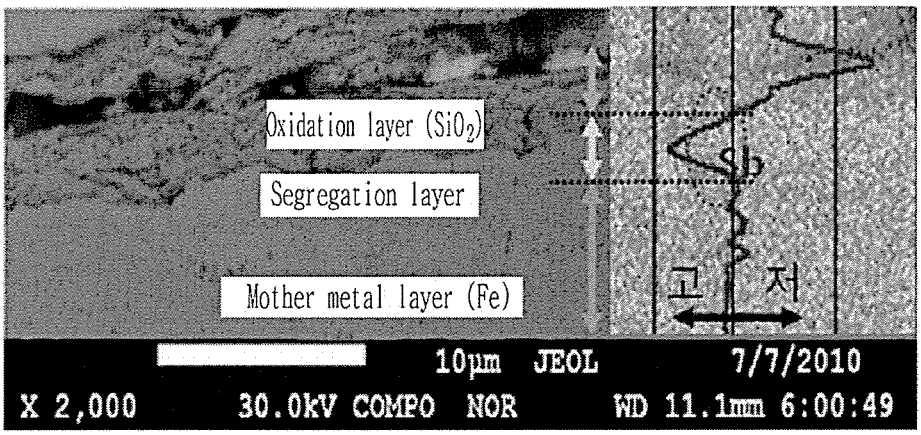
FIG. 4 is a field emission transmission electron probe microanalyzer (FE-EPMA) image and an analysis result thereof for a side surface of a cold rolled sheet from step S40 in Example 1.

A field emission transmission electron probe microanalyzer (FE-EPMA) image and an analysis result for the side surface of the cold rolled sheet after the primary recrystallization annealing are shown in FIG. 4. As shown in FIG. 4, it may be confirmed that the mother material metal layer, the segregation layer, and the oxidation layer are sequentially formed.

Next, the metal chloride and the metal iodide are added to the annealing separating agent including MgO as the main component as in Table 1, and the annealing separating agent is coated on the steel sheet and is annealed for the secondary recrystallization in a coil shape. At the time of the secondary recrystallization annealing, the primary soaking temperature is 700° C., the secondary soaking temperature is 1200, ° C., and the rising temperature speed is 15° C./h. On the other hand, a soaking time at 1200° C. is 15 hours for the processing. The atmosphere in the final annealing is a mixed atmosphere of 75 volume % of nitrogen and 25 volume % of hydrogen up to 1200° C., and a 100 volume % hydrogen atmosphere is maintained after reaching 1200° C., then the furnace is cooled. For the finally obtained oriented electrical steel sheet, in the state that the surface is cleaned and then the insulating film is not coated, the magnetic flux density, the core loss, and the surface roughness are measured.

Figure 5:
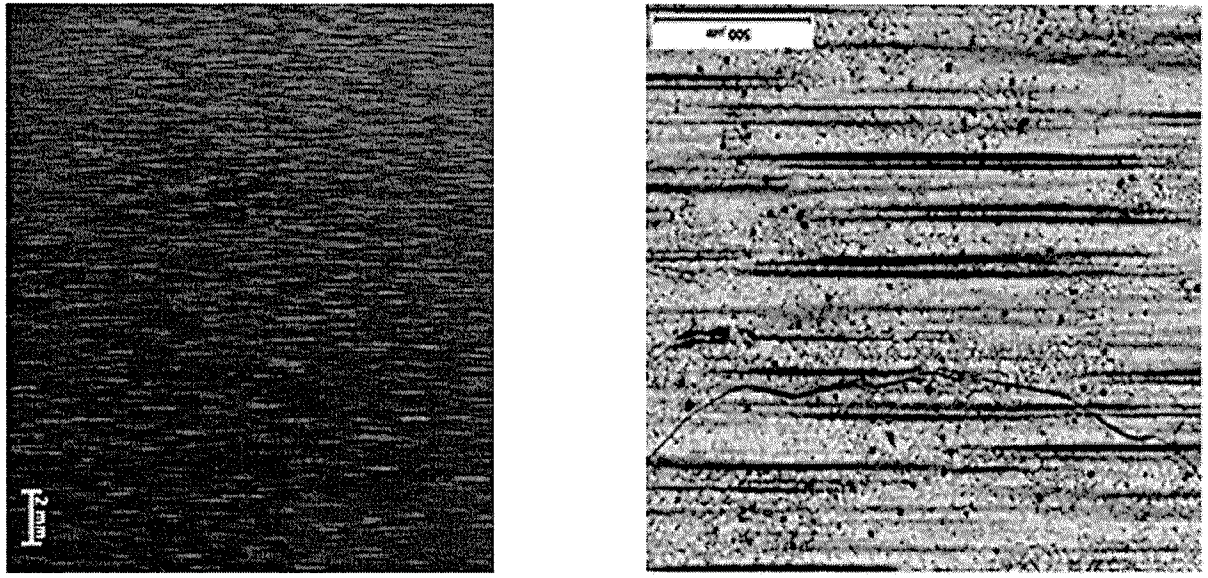
FIG. 5 shows scanning electron microscope (SEM) photographs of an oriented electrical steel sheet manufactured in Example 1.

The manufacture oriented electrical steel sheet is as shown in FIG. 5. It may be confirmed that the protrusions and depressions are parallel to the rolling direction.

In detail, in the case of the magnetic flux density, the intensity of the magnetic field at 800 Nm is measured by using a single sheet measuring method of the core loss in a 1.7 T/0 Hz condition, and the surface roughness is measured by using a roughness system (Surftest-SJ-500).

TABLE 1

| | Primary recrystallization annealing dew point condition (° C.) | | | Oxidation layer | Annealing separation | Magnetic | Core | |
|---|---|---|---|---|---|---|---|---|
| | Heating zone | Primary soaking | Secondary soaking | amount (ppm) | additive (wt %) | density (T) | loss (W/kg) | Roughness (um) |
| Comparative Example 1 | 45 | 48 | 53 | 358 | $BiCl_3$/ 10% | 1.88 | 1.12 | 0.38 |

TABLE 1-continued

| | Primary recrystallization annealing dew point condition (° C.) | | | Oxidation layer | Annealing separation | Magnetic | Core | |
|---|---|---|---|---|---|---|---|---|
| | Heating zone | Primary soaking | Secondary soaking | amount (ppm) | additive (wt %) | density (T) | loss (W/kg) | Roughness (um) |
| Comparative Example 2 | 52 | 54 | 67 | 735 | $BiCl_3$/ 10% | 1.90 | 0.99 | 0.68 |
| Comparative Example 3 | 56 | 65 | 72 | 952 | $BiCl_3$/ 10% | 1.89 | 1.03 | 0.83 |
| Cornparative Example 4 | 53 | 56 | 65 | 712 | — | 1.91 | 1.01 | 0.45 |
| Comparative Example 5 | 52 | 54 | 67 | 735 | CuI/ 3% | 1.88 | 1.09 | 0.92 |
| Example 1 | 51 | 55 | 68 | 741 | CuI/ 8% | 1.92Bi | 0.93 | 0.65 |
| Example 2 | 56 | 63 | 69 | 822 | CuI/ 13% | 1.91 | 0.95 | 0.71 |
| Example 3 | 55 | 59 | 63 | 652 | CuI/ 20% | 1.91 | 0.95 | 0.52 |
| Comparative Example 6 | 56 | 63 | 68 | 798 | $BiCl_3$/ 15% | 1.89 | 1.05 | 0.41 |
| Comparative Example 7 | 50 | 53 | 56 | 539 | CuI/ 10% | 1.87 | 1.14 | 0.57 |
| Comparative Example 8 | 60 | 66 | 75 | 913 | CuI/ 10% | 1.90 | 1.04 | 0.53 |

As shown in Table 1, when the dew point of the primary annealing furnace is lower 50° C. or higher than 70° C., the mirror surface degree of the steel sheet is not good such that it may be confirmed that the magnetism characteristic is deteriorated. Also, when using the metal iodide rather than the metal chloride as the annealing separating agent additive, the magnetism characteristic is improved. Resultantly, the metal gloss oriented electrical steel sheet having the easy mobility of magnetic domains may be obtained through the examples, and in this case, as the oxygen amount in the oxidation layer is similar to a comparative example, the decarburization property of the mother material may be obtained such that it may be confirmed that the inhibitor is stable at the time of the secondary recrystallization annealing to be magnetically excellent and the productivity is also high.

Although exemplary embodiments of the present invention were described above, those skilled in the art would understand that the present invention may be implemented in various ways without changing the spirit or necessary features. Therefore, the embodiments described above are only examples and should not be construed as being limitative in any respects.

DESCRIPTION OF SYMBOLS

10: metal mother material layer
20: segregation layer
30: oxidation layer
40: protrusions and depressions

The invention claimed is:

1. A manufacturing method of an oriented electrical steel sheet, comprising:

a step of manufacturing a steel slab including one kind or more among Si at 2 to 7%, Sn at 0.03 to 0.10%, and Sb at 0.01 to 0.05% as wt %;

a step of hot-rolling the steel slab to manufacture a hot rolled sheet;

a step of cold-rolling the hot rolled sheet to manufacture a cold rolled sheet;

a step of decarburizing and nitriding the cold rolled sheet for primary recrystallization annealing;

a step of coating and drying an annealing separating agent on the primary recrystallization-annealed cold rolled sheet; and a step of secondary recrystallization-annealing the cold rolled sheet coated with the annealing separating agent, wherein the primary recrystallization annealing is performed by passing through a heating zone, a primary soaking zone, and a secondary soaking zone, and satisfies Equation 1, Equation 2 and Equation 3 below when each dew point is t1, t2, and t3, the annealing separating agent includes a magnesium oxide or a magnesium hydroxide, and a metal iodide, and a forsterite ($Mg_2SiO_4$) film is removed in the step of the secondary recrystallization annealing:

$$50° \text{ C.} \leq t1 < t2 < t3 \leq 70° \text{ C.} \quad (1)$$

$$t2 - t1 \geq 4° \text{ C.} \quad (2)$$

$$t3 - t2 \geq 4° \text{ C.} \quad (3).$$

2. The manufacturing method of the oriented electrical steel sheet of claim 1, wherein after the primary recrystallization annealing, a mother material metal layer, a segregation layer, and an oxidation layer are sequentially formed, and the segregation layer includes 50 to 100 wt % of one kind or more of Sb and Sn.

3. The manufacturing method of the oriented electrical steel sheet of claim 2, wherein the thickness of the oxidation layer is from 0.5 to 2.5 μm, and an oxygen amount of the oxidation layer is 600 ppm or more.

4. The manufacturing method of the oriented electrical steel sheet of claim 1, wherein the annealing separating agent includes the magnesium oxide or magnesium hydroxide at 100 parts by weight and the metal iodide at 5 to 20 parts by weight.

5. The manufacturing method of the oriented electrical steel sheet of claim 1, wherein a metal forming the metal iodide includes one selected from Ag, Co, Cu, and Mo, and combinations thereof.

6. The manufacturing method of the oriented electrical steel sheet of claim 1, wherein the step of the secondary recrystallization annealing is performed in a temperature range of 650 to 1200° C.

7. The manufacturing method of the oriented electrical steel sheet of claim 6, wherein in the step of the secondary recrystallization annealing, the cold rolled sheet is heated from 650 to 1200° C. with a temperature raising rate of 0.1 to 20° C./h, and is maintained for 20 hours or more in a temperature range of 1150 to 1250° C. after reaching 1200° C.

8. The manufacturing method of the oriented electrical steel sheet of claim 1, wherein a surface roughness of the oriented electrical steel sheet is 0.8 μm or less as a Ra value.

9. The manufacturing method of the oriented electrical steel sheet of claim 8, wherein the surface of the oriented electrical steel sheet includes protrusions and depressions parallel to a rolling direction.

* * * * *